United States Patent [19]

Cochran et al.

[11] Patent Number: 4,805,917

[45] Date of Patent: Feb. 21, 1989

[54] BASKETBALL GAME

[75] Inventors: Ken C. Cochran; Donald R. Frye, both of Salina, Kans.

[73] Assignee: Pop-A-Shot, Inc., Salina, Kans.

[21] Appl. No.: 84,849

[22] Filed: Aug. 13, 1987

[51] Int. Cl.[4] ..... A63B 63/08

[52] U.S. Cl. ..... 273/397

[58] Field of Search ..... 273/397, 1.5, 179, 125 A, 273/182 A, 122 A, 352, 395, 396; D21/201

[56] References Cited

U.S. PATENT DOCUMENTS

| | | | |
|---|---|---|---|
| 1,799,263 | 4/1931 | Swain et al. | 273/179 B X |
| 1,924,757 | 8/1933 | Shisoff | 273/379 |
| 2,499,559 | 3/1950 | Babits et al. | 273/125 A |
| 2,609,199 | 9/1952 | Koener | 273/125 A X |
| 2,617,653 | 11/1952 | Keller | 273/1.5 R |
| 3,044,778 | 7/1962 | Beck et al. | 273/125 A |

FOREIGN PATENT DOCUMENTS

| | | | |
|---|---|---|---|
| 214026 | 11/1957 | Australia | 273/125 A |

*Primary Examiner*—Paul E. Shapiro

*Attorney, Agent, or Firm*—Kokjer, Kircher, Bradley, Wharton, Bowman & Johnson

[57] ABSTRACT

An arcade type basketball game comprising a framework and basket and a gate for controlling access to the balls. The gate is mounted to a shooting window having an opening for passage of the balls. A gate bar is moveable to a position blocking the opening and is coupled with a pair of solenoids with vertically extendable and retractable plungers. Rigid upper and lower return boards are forwardly inclined for returning the balls more quickly to the player by reducing the vertical component of the ball movement. Netting and vinyl coupled with the framework prevent the balls from bouncing away.

13 Claims, 1 Drawing Sheet

BASKETBALL GAME

BACKGROUND OF THE INVENTION

This invention relates in general to arcade type games and, more particularly, to a basketball game.

Arcade type basketball games which test the shooting skill of an individual are a popular form of entertainment for people of all ages. These games utilize a basket comprising a backboard and a rim through which the player attempts to toss a basketball. The basket is typically positioned at one end of a framework and the players must stand at the other end of the framework while shooting the ball. Netting or similiar material is coupled with the framework to funnel the ball back to the player after a shot is attempted.

While the method of playing these games may be varied, the primary object is to make as many shots as possible within a predetermined period of time. If only one ball is utilized, the player must wait as the ball is funneled by the netting back to the player after a shot attempt. To reduce this delay, more than one ball may be utilized. It is desirable, however, to limit the number of balls required because of their expense and the likelihood that they will be lost or stolen. A method for more quickly returning the balls to the player would allow fewer balls to be used while at the same time ensuring that a ball is always available to the player for shooting.

It is also desirable to provide a method for blocking the return of the balls to the player after expiration of the time period for shooting. It has been previously suggested that a moveable gate may be utilized to retain the balls behind a partition spaced from the player to prevent access to the balls. Such a gate utilizes components such as a cam, cam follower, and a return spring which are coupled by a linkage to a solenoid. These components lack sufficient durability in the face of repeated impact by the balls and their use in indirectly regulating movement of the gate fails to achieve the desired reliability of operation. In addition, the linkage requires continual maintenance to ensure proper operation of the gate.

SUMMARY OF THE INVENTION

It is an object of this invention to provide a basketball game with a durable gate to block the return of balls to a player after the time period for play has expired.

It is another object of this invention to provide a basketball game with means for more quickly returning the balls to the player after a shot has been attempted so that fewer balls need be utilized while still ensuring that a ball is always available for shooting.

To accomplish these and other objects of the invention, a basketball game is provided with a basket coupled with a rear portion of a framework and a gate positioned between the basket and the front portion of the framework. The gate is vertically moveable between a first position allowing return of the balls to the front portion of the framework and a second position blocking the return of the balls. The gate is moveable between said first and second positions by one or more solenoids mounted above the gate. A return chute comprising a rigid board may also be coupled with the framework and forwardly inclined to more quickly return the balls to the player.

BRIEF DESCRIPTION OF THE DRAWINGS

In the drawings where like reference numerals are used to represent like parts in the various views.

DESCRIPTION OF THE PREFERRED EMBODIMENT

Figure 1:
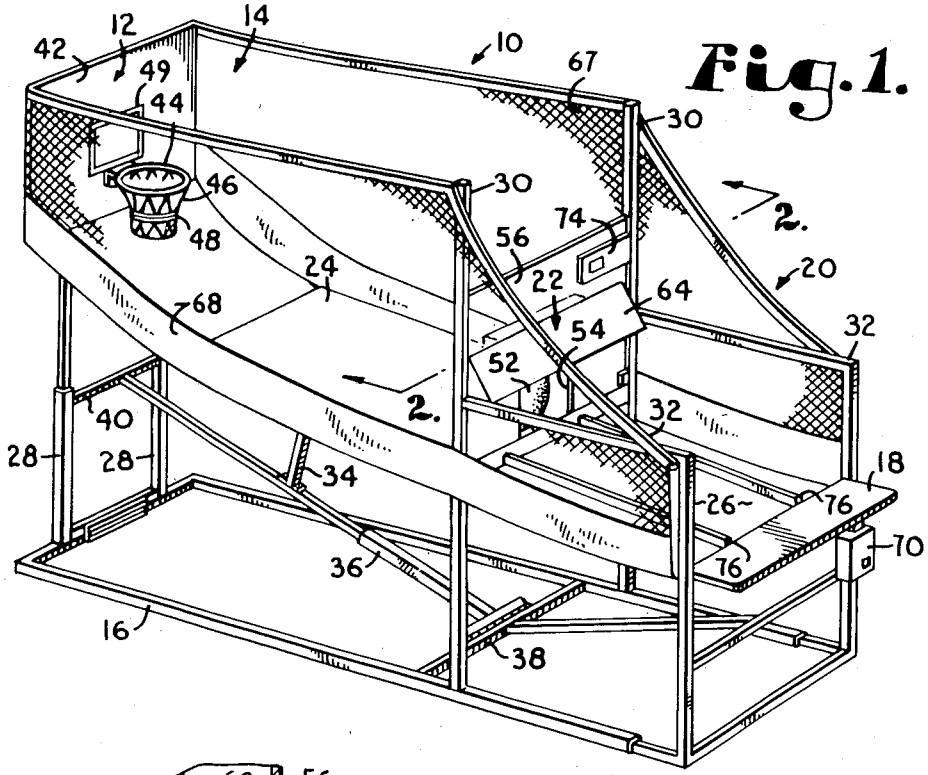
FIG. 1 is a perspective view of a basketball game of the present invention.

Referring now to the drawings and initially to FIG. 1, the basketball game of the present invention is represented generally by the numeral 10. The basketball game 10 comprises a basket 12 coupled with a rear portion 14 of a collapsible framework 16, a shooting board 18 coupled with a front portion 20 of the framework, and a gate mechanism 22 positioned between the front and rear portions of framework 16. An upper return board 24 and a lower return board or chute 26 are also coupled with the framework.

Framework 16 comprises rear support posts 28 on which basket 12 is mounted, center support posts 30 which mount the gate mechanism 22, and front support posts 32. A support leg 34 is coupled with upper return board 24 and is braced by extendable member 36 which is coupled with cross-members 38 and 40. Framework 16 is preferably of a lightweight construction to allow for easy portability of game 10. To facilitate this, posts 28, 30 and 32 may also be folded to a horizontal position.

Basket 12 comprises a backboard 42, a circular rim 44 coupled with the backboard, and a net 46 coupled with the rim. A collar 48 may be coupled with the net 46 for housing a sensor (not shown) such as a microswitch for detecting the passage of a ball through the net. A square-shaped target area 49 may be painted or outlined by other suitable means on the backboard 42.

Figure 2:
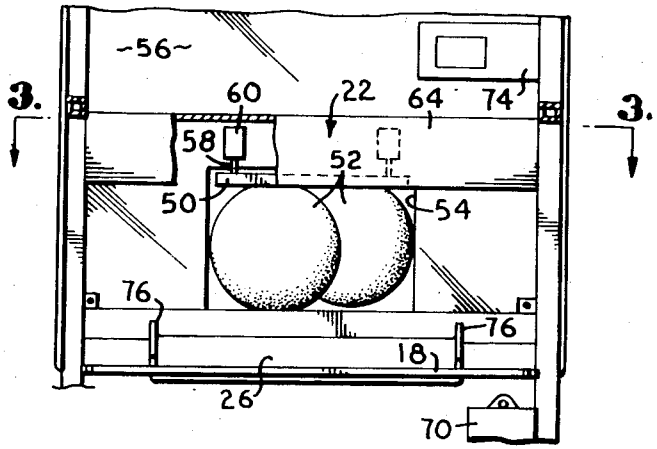
FIG. 2 is a fragmentary front elevational view of the gate mechanism taken along line 2—2 of FIG. 1.
Figure 3:
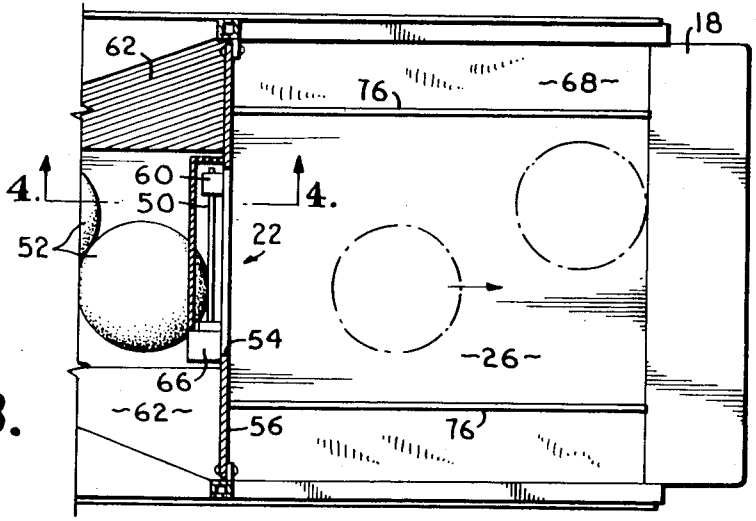
FIG. 3 is a fragmentary top plan view of the gate mechanism and a ball return chute taken along line 3—3 of FIG. 2.
Figure 4:
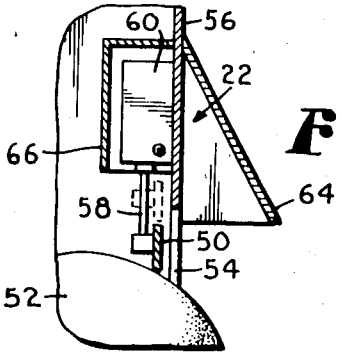
FIG. 4 is a fragmentary side elevational view of the gate mechanism taken along line 4—4 of FIG. 3.

Turning now to FIGS. 2–4, the gate mechanism 22 comprises a gate bar 50 which is vertically moveable to block the passage of balls 52 through an opening 54 in a transparent partition or shooting window 56. The horizontally extending gate bar 50 spans substantially the distance across opening 54. A pair of solenoids 58 comprising plungers 59 and coils 60 are mounted on the rear side of window 56 directly above opening 54 and adjacent funnel portions 62. The solenoids are positioned such that plungers 59 extend vertically downward toward opening 54. The plungers 59 are directly connected to the gate bar 50 and may be moved vertically between extended and retracted positions by de-energizing and energizing coils 60.

Window 56 is coupled with center support posts 30 and preferably comprises "Plexiglas", "Lexan" or similar synthetic material which is transparent and resistant to breakage. Opening 54 is centrally located at the bottom of the window and is of a width and height to allow passage of the balls 52 through the window. As best shown in FIG. 4, a front cover 64 may be coupled with the front of the shooting window 56 and a protective shield 66 may be used to encase the solenoids 60.

Returning now to FIG. 1, netting 67 and vinyl or similar material 68 is coupled with framework 16 to prevent the ball from bounding away from the framework. Netting 67 is used along the sides of the framework so that on-lookers may view the basket 12. Vinyl 68 is coupled with the lower portion of backboard 42 and extends beneath return boards 24 and 26 to the front portion 20 of framework 16. Also coupled with the framework at front portion 20 are a coin box 70 and a ticket dispenser 72. As shown in FIG. 2, a scoreboard 74 may be mounted on a center post 30.

The basketball game 10 may be activated for play by depositing coins or tokens into coin box 70. The gate bar 50 is then moved from a first position shown in solid lines in FIG. 4 to a second position represented by broken lines in the same figure. The bar is moved from the first to the second position by retraction of plungers 58 within coils 60. When the gate bar is in the first position, the distance from the bottom of the opening to the bar is less than the diameter of the balls 52. The balls are thus prevented from passing through the opening 54. When the bar is moved to the second position, the vertical distance from the bottom of the opening to the bar is greater than the ball diameter, allowing passage of the balls through the opening.

It is desired that plungers 59 be of a short length to reduce any likelihood of bending if impacted by a ball. To this end, the opening 54 should be of a slightly greater height than the diameter of the balls 52 and the solenoids 58 should be mounted near the top of the opening. Preferably, the gate bar 50 and plungers should travel approximately ½" when moved between the first and second positions.

As the balls 52 pass through opening 54, they drop onto the forwardly inclined lower return chute 26 and roll towards the shooting board 18. While the degree of inclination of chute 26 may be varied, it has been found that a 15° inclination is preferable. The inclination and rigidity of the chute 26 imparts a greater forward motion to the balls and decreases the travel time of the ball from the gate to the shooting board where the player is positioned. In the absence of the rigid chute the balls would fall on the flexible vinyl material 68. A ball dropping on the vinyl would cause the vinyl to flex under the weight of the ball and, as the vinyl springs back, would impart a vertical motion to the ball rather than the desired forward motion. By reducing this flexure with the use of the rigid chute 26, the balls travel more quickly in a forward direction and reach the shooting board 18 in less time.

Board 18 is elevated slightly above the return chute 26 and stops the travel of the balls. Raised side rails 76 which extend upwardly from the sides of the chute ensure that the balls are centrally positioned at the shooting board 18 and are within easy reach of a player positioned adjacent to the front edge of the shooting board. The player may then pick up a ball and attempt to shoot the ball through the rim 44. The netting 67 and vinyl 68 then cooperate to retain the ball within the framework 16 and funnel it toward the gate mechanism 22. While the gate bar 50 remains in the second position, the balls pass through the opening 54 and are returned to the player for further shot attempts.

The forwardly inclined upper return board 24 also provides a firm surface for decreasing the return time of the balls to the player after a shot attempt. An inclination of 15° is preferred but may of course be varied. The support leg 34 and bracing member 36 provide a solid support for the return board and reduce any flexing of the board when impacted by the balls 52. The inclination of the board causes the balls to bounce forwardly toward the player, but the shooting window 56 prevents balls from reaching the player unless they pass through the gate 22. This reduces any distraction or injury the bouncing balls might cause if they impact the player while he or she is shooting. The transparency of the window also gives shorter players an unobstructed view of the basket.

The protective shield which envelops the solenoids 58 prevents the balls from damaging the gate mechanism 22. By placing the solenoids near the upwardly extending funnel portions 62, the likelihood that a ball will bounce into and damage the solenoid plungers 58 is greatly reduced.

The microswitch in collar 48 records the passage of the balls through the net 48 for display on scoreboard 74. The scoreboard may also include a timer for displaying the amount of time remaining. After the expiration of the predetermined period of time, the gate bar 50 is lowered to its first position by downward extension of the solenoid plungers 59. The balls are then prevented from passing through the opening 54. The shooting window 56 then acts as a partition and blocks player access to the balls. If the player has made a predetermined number of shots during the allotted time, prize tickets may be awarded from ticket dispenser 72.

By utilizing a rigid return board 24 and chute 26, the number of balls required to ensure that a ball is always available to the player is reduced. In addition, by utilizing solenoids 58 mounted above the gate opening 54 and shielding the solenoids by protective shield 66, the likelihood of damage to the gate is greatly reduced. The direct coupling of the solenoid plungers 59 to the gate bar 50 also provides greater control over the movement of the gate bar and eliminates problems associated with the use of a linkage to indirectly operate the gate.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. A basketball game comprising:

a framework having front and rear portions;

a basket mounted on the rear portion of the framework;

partition coupled with the framework and positioned between the front and rear portions of the framework, said partition having an opening for passage of said balls;

a gate bar coupled with said partition said gate bar being moveable between a first position allowing said ball to return to the front portion and a second position blocking said return;

a solenoid coupled with said partition and positioned above said opening;

said solenoid comprising a vertically extendable and retractable plunger coupled with said gate bar for moving the gate bar between said first and second positions;

means coupled with said framework for returning a ball from the rear to the front portion after a shot attempt; and wherein said return means comprises a forwardly inclined rigid chute positioned between said gate and the front portion of the framework.

2. The invention of claim 1, including a second solenoid coupled with said partition and positioned above said opening and having a vertically extendable and retractable plunger coupled with said gate bar.

3. The invention of claim 2, including a protective shield enclosing said solenoids for protecting the latter from impact from said ball.

4. The invention of claim 1, wherein said ball return means comprises a flexible fabric coupled with the framework along sides thereof to funnel the ball to the gate.

5. The invention of claim 1, wherein said ball return means comprises a rigid return board positioned between said rear portion of the framework and said gate.

6. The invention of claim 1, wherein said rigid chute includes upwardly extending side rails for maintaining said ball on the chute.

7. A basketball game comprising:

a framework having front and rear portions;

a basket coupled with said rear portion of the framework;

means coupled with said framework for returning a ball from the rear to the front portion after a shot attempt;

a partition coupled with said framework between the front and rear portions and having an opening for passage of said ball; and a gate coupled with said partition and comprising a solenoid mounted above said opening and a gate bar, said solenoid including a vertically extendable plunger coupled with said gate bar, wherein said gate bar is moveable by extension and retraction of said plunger between a first position blocking passage of said ball through the opening and a second position allowing said passage.

8. The invention of claim 7, wherein said return means comprises a forwardly inclined rigid chute positioned between said gate and the front portion of the framework.

9. The invention of claim 7, wherein said ball return means comprises a flexible fabric coupled with the framework along sides thereof to funnel the ball to the gate.

10. The invention of claim 7, wherein said ball return means comprises a rigid return board positioned between said rear portion of the framework and said gate.

11. The invention of claim 7, wherein said rigid chute includes upwardly extending side rails for maintaining said ball on the chute.

12. The invention of claim 7, including a second solenoid positioned above said opening and having a vertically extendable and retractable plunger.

13. The invention of claim 7, including a protective shield enclosing said solenoid for protecting said gate from impact from said ball.

* * * * *